United States Patent [19]

Dell-Imagine

[11] 3,984,840

[45] Oct. 5, 1976

[54] BOOTLACE LENS HAVING TWO PLANE SURFACES

[75] Inventor: Robert A. Dell-Imagine, Orange, Calif.

[73] Assignee: Hughes Aircraft Company, Culver City, Calif.

[22] Filed: July 17, 1975

[21] Appl. No.: 596,882

[52] U.S. Cl. ..... 343/754; 343/854

[51] Int. Cl.[2] ..... H01Q 15/06

[58] Field of Search ..... 343/754, 854, 777, 778, 343/853

[56] References Cited

UNITED STATES PATENTS 2,986,734 5/1961 Jones et al. ..... 343/754

*Primary Examiner*—Eli Lieberman

*Attorney, Agent, or Firm*—Robert H. Himes; W. H. MacAllister

[57] ABSTRACT

A planar constrained lens (bootlace lens) antenna is disclosed capable of providing a large one or two dimensional field of view with either a scanning feed or with multiple feeds. This planar constrained lens antenna is of the type which can replace both narrow field of view and wide field of view lenses in multiple beam communications satellite and in limited scan radars using focal plane scanning or with a two element lens system and a scanning phased array feed.

3 Claims, 4 Drawing Figures db
0
-10
-20
-30
-40
-50
-60
-4.0
-3.0
-2.0
-1.0
0
1.0
2.0
3.0
4.0
5.0
Scan Angle θ° db
10
0
-10
-20
-30
-40
-50
-60
0
1.0
2.0
3.0
4.0
5.0
6.0
7.0
8.0
9.0
Scan Angle θ°

BOOTLACE LENS HAVING TWO PLANE SURFACES

BACKGROUND OF THE INVENTION

Existing designs for wide angle scanning bootlace lenses require a spherical pickup array together with a planar radiating array. The two arrays are connected element by element through equal length cables. The resulting structure occupies a large volume and is difficult to fabricate. The connecting cables are generally longer than those of the flat constrained lens.

SUMMARY OF THE INVENTION

In accordance with the invention, a planar pickup surface is used in conjunction with a planar radiating surface. The spacing of corresponding (connected) elements in the pickup and radiating surfaces is such as to satisfy the Abbé Sine Condition of geometrical optics thereby to guarantee that no first order phase errors are introduced as the feed moves away from the axis of rotation of the pickup surface.

The planar constrained lens provides a compact constrained lens with minimum cable lengths and the planar pickup and radiating surfaces allow a simpler structure. In narrowband applications, the cables can be shortened by multiples of a wavelength in zones thereby reducing cable weight and loss without modifying the wide field of view available.

DESCRIPTION

Figure 1:
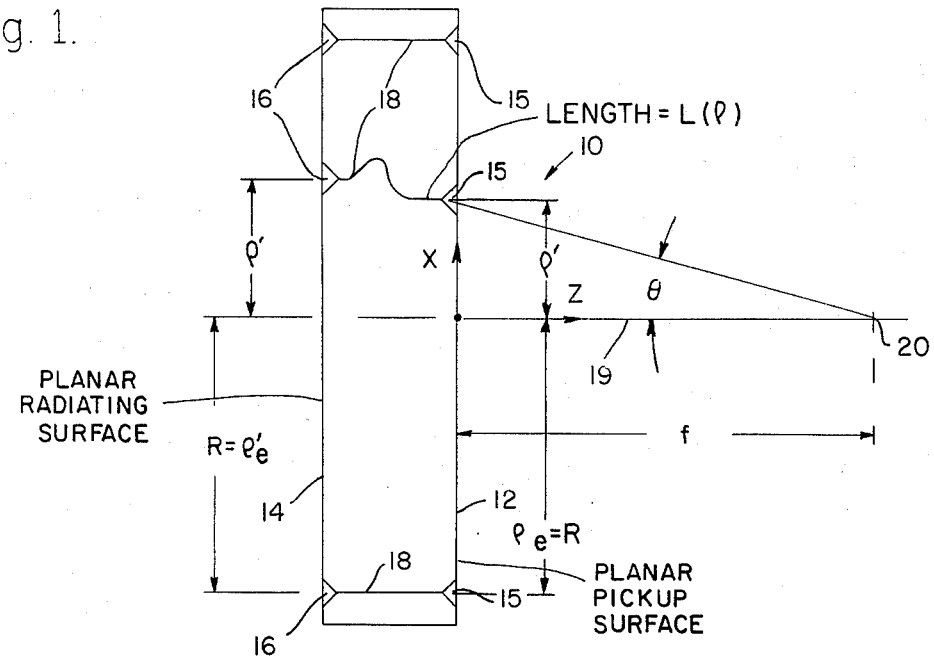
FIG. 1 shows a schematic representation of a cross-sectional view through the major diameters of the radiating and pickup arrays of the present invention.

Referring to FIG. 1 there is illustrated a cross-sectional schematic view of the planar constrained lens antenna 10 of the present invention taken through a major diameter. The antenna 10 includes a planar pickup surface 12 disposed parallel to, coextensive with and spaced from a planar radiating surface 14. The pickup surface 12 includes a number of feedhorns 15 which are connected to corresponding radiating elements 16 through cables 18. The arrangement of the feedhorns 15 of the pickup surface 12 can be a plurality of horizontal and vertical linear arrays or other patterns, it being usually desirable to have adjacent feedhorns 15 spaced within one-half wavelength of each other. The radiating elements 16 of the radiating surface 14 correspond to respective radiating elements 15 of pickup surface 12, however, and are located so as to satisfy the Abbe Siné Condition of geometrical optics. This condition is acheived by changing the spacing of the radiating elements 16 as compared to the corresponding feedhorns 15 relative to the optical axis 19 of antenna 10, as will be hereinafter explained. In this respect, the antenna 10 has a feed 20 at the focal point thereof which is spaced a distance $f$ along the axis 19 from the pickup surface 12; the distance of a feedhorn 15 of pickup surface 12 from axis 19 is designated $\rho$;

and the angle subtended by this feedhorn 15 from the feed 20 is designated $\theta$.

Thus a feedhorn 15 located a distance $\rho$ from the axis 19 is excited by a ray which leaves the feed 20 located at the focal point of antenna 10 at an angle $\theta$ to the optical axis 19. Under these circumstances, $$\tan \theta = \rho/f. \tag{1}$$

The Abbé Sine Condition requires that the ray leave the antenna 10 at a distance $\rho'$ from the optical axis 19 that is proportional to sin $\theta$. Thus, if $k$ is a constant, then $$\rho' = k \frac{\rho}{\sqrt{f^2 + \rho^2}}. \tag{2}$$

In order for the ray to leave the antenna 10 at the distance $\rho'$ from the optical axis 19, the radiating element 16 corresponding to the feedhorn 15 which receives the ray, i.e., the element 16 that is connected to the feedhorn 15, is located at a point that is the distance $\rho'$ from the optical axis 19. Normally, a plane through the optical axis 19 and a feedhorn 15 will also pass through the corresponding radiating element 16. In any event, planes through the optical axis 19 and feedhorns 15 will have a fixed angular relationship to corresponding radiating elements 16.

A criteria for choosing the constant, $k$, is to require that the element 15, 16 located at the outer edge of the antenna 10 have the same distance, R, from the optical axis 19. Thus, if $\rho_e' = \rho_e = R$ where $\rho'_e$ and $\rho_e$ are the distances of elements 16, 15, respectively, from the optical axis 19 when located at the outer periphery of the antenna 10, then from equation (2):

$$\rho_e' = \frac{k R}{\sqrt{f^2 + R^2}} \tag{3}$$

whereby $$k = \sqrt{f^2 + R^2} \tag{4}$$

Substituting equation (4) into equation (2)

$$\rho' = \frac{\sqrt{f^2 + R^2}}{\sqrt{f^2 + \rho^2}} \rho . \tag{5}$$

Equation (5) specifies the location of the radiating elements 16 of radiating surface 14 in terms of the location of corresponding feedhorn elements 15 of pickup surface 12. The equation (5) is easily inverted to determine $\rho$ as a function of $\rho'$ whereby:

$$\rho = \frac{f\rho'}{\sqrt{f^2 + R^2 - \rho'^2}}. \tag{6}$$

Lastly, the lengths of the connecting cables 18 are adjusted in a manner to equalize the distance a ray travels from the feed 20 to the feedhorns 15 of the pickup surface 12. For example, the cable 18 on the optical axis 19 is made longer by the additional distance that a ray has to travel to reach the outer periphery of the pickup surface 12. Stated mathematically, the length, L($\rho$), of a cable 18 at a distance $\rho$ from the optical axis 18 is:

$$L(\rho) = \sqrt{f^2 + R^2} - \sqrt{f^2 + \rho^2} + L \qquad (7)$$

where L is a constant that is chosen to make all the cables 18 have a usable length.

Figure 4:
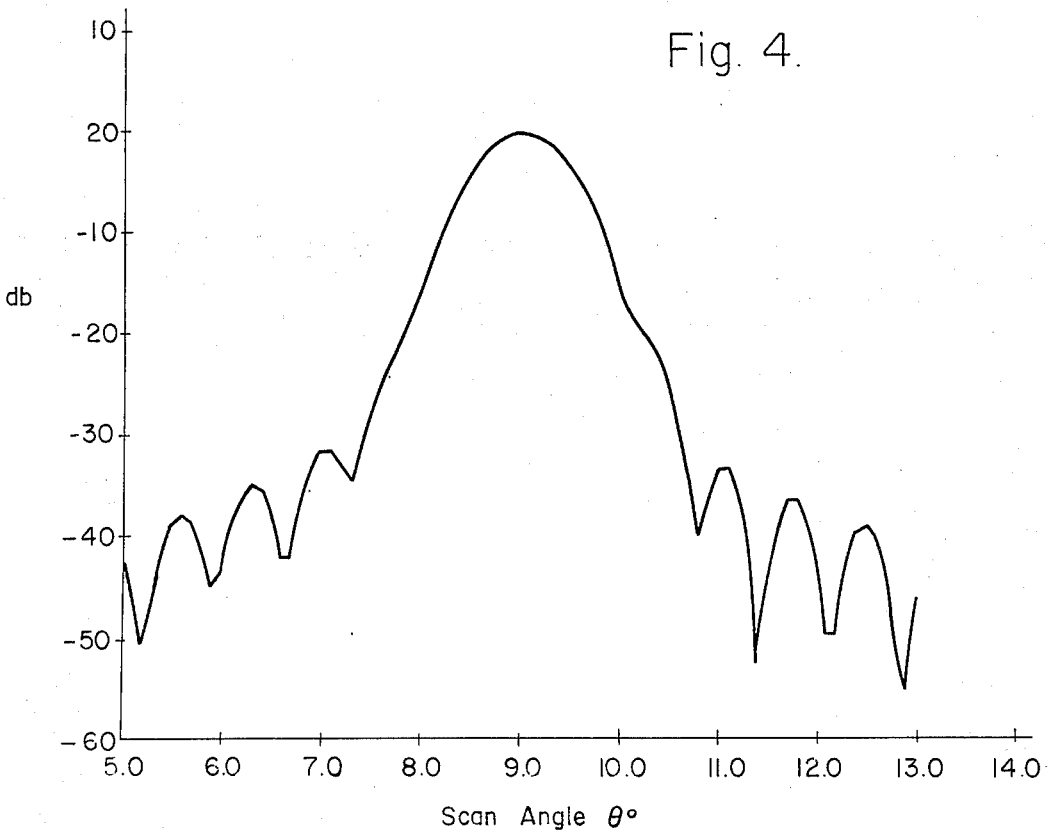
FIG. 4 illustrates the pattern for 9.0° scan for the antenna of FIG. 1.
Figure 2:
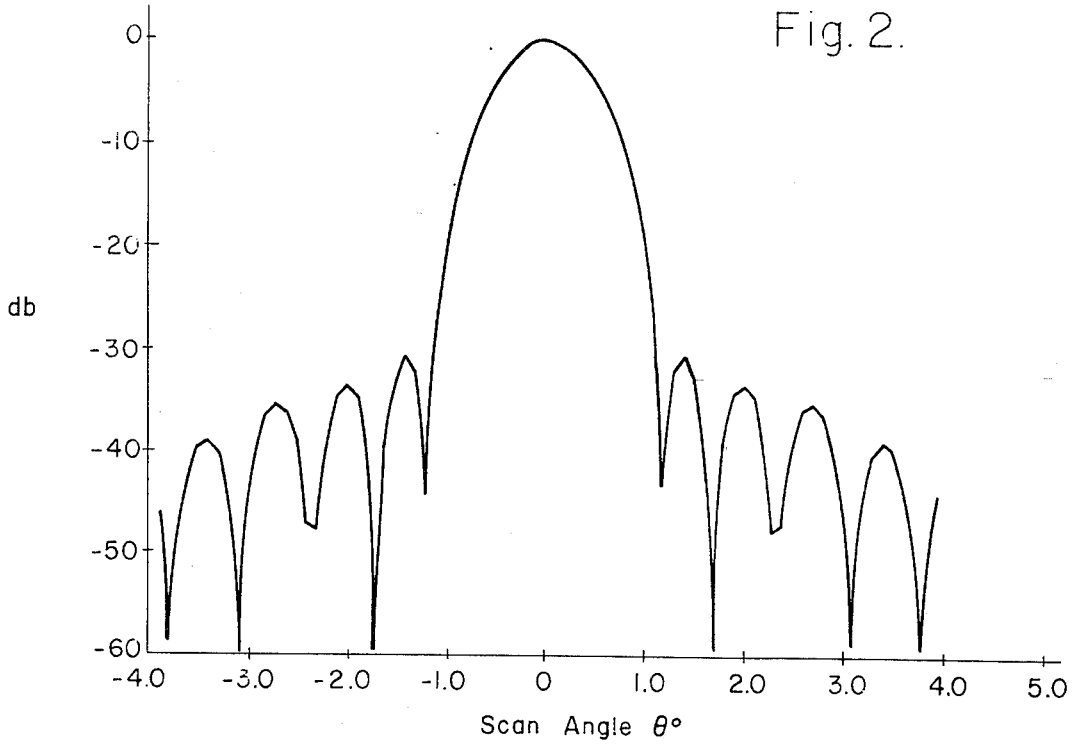
FIG. 2 illustrates the broadside pattern of the antenna of FIG. 1.
Figure 3:
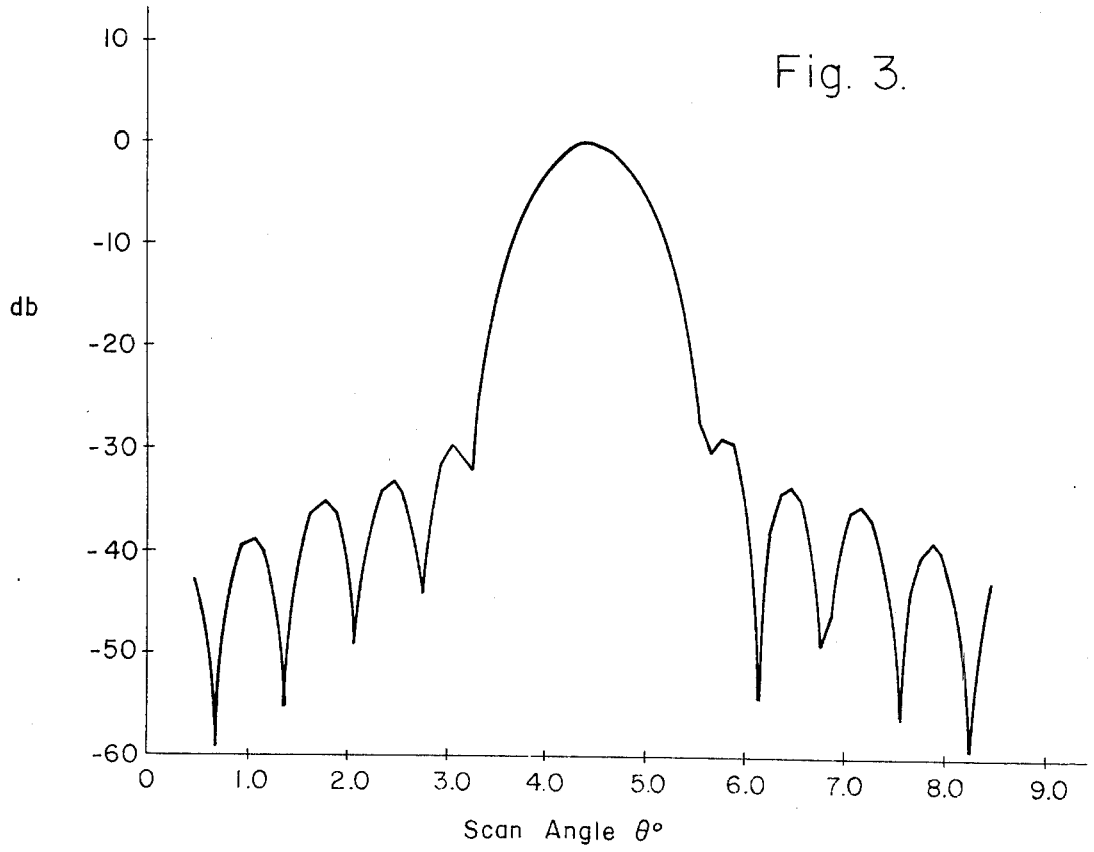
FIG. 3 illustrates the pattern for 4.5° scan for the antenna of FIG. 1.

FIGS. 2, 3 and 4 illustrate field intensity patterns for the antenna 10 of FIG. 1 for broadside, for a scan angle of 4.5° and for a scan angle of 9°, respectively.

What is claimed:

1. A planar constrained lens antenna comprising a planar pickup array of receiving elements, said pickup array having an optical axis with a focal point disposed a distance $f$ therealong from said planar array, the distance of any receiving element of said planar array from said optical axis being designated $\rho$; a planar array of radiating elements each corresponding to a discrete receiving element of said pickup array, the distance of a corresponding radiating element from the center of said radiating array is designated $\rho'$ where $$\rho' = k \frac{\rho}{\sqrt{f^2 + \rho^2}}$$

wherein $k$ is a constant; means for connecting corresponding receiving and radiating elements with an electrical conductor of a length to equalize the distance from said focal point to any respective radiating element; and a feed disposed along said optical axis at said focal point.

2. The planar constrained lens antenna as defined in claim 1 wherein corresponding receiving and radiating elements located at the outer edge of said pickup array and said planar array of radiating elements, respectively, have the same distance, R from said optical axis whereby $$\rho' = \frac{\sqrt{f^2 + R^2}}{\sqrt{f^2 + \rho^2}} \rho .$$

3. The planar constrained lens antenna as defined in claim 1 wherein corresponding receiving and radiating elements located at the outer edge of said pickup array and said planar array of radiating elements, respectively, have the same distance, R from said optical axis whereby $$\rho = \frac{f\rho'}{\sqrt{f^2 + R^2 - \rho'^2}} .$$

* * * * *